United States Patent [19]

Jayne

[11] Patent Number: 4,618,155

[45] Date of Patent: Oct. 21, 1986

[54] STAIR-CLIMBING WHEELCHAIR

[76] Inventor: Laurence I. Jayne, 510 Marshall St., Davenport, Wash. 99122

[21] Appl. No.: 797,436

[22] Filed: Nov. 13, 1985

[51] Int. Cl.[4] ..... A61G 5/02

[52] U.S. Cl. ..... 280/5.28; 180/8.2; 280/5.3; 280/DIG. 10

[58] Field of Search ..... 280/5.3, 5.32, 5.2, 280/5.28, DIG. 10; 180/8.2

[56] References Cited

U.S. PATENT DOCUMENTS

| | | | |
|---|---|---|---|
| 468,022 | 2/1892 | Bray | 280/5.28 |
| 572,658 | 12/1896 | Marx | 280/5.28 |
| 1,897,036 | 2/1933 | Appenheimer | 280/5.2 |
| 3,104,112 | 9/1963 | Crail | 280/5.2 |
| 3,169,596 | 2/1965 | Wright | 180/7.2 |
| 3,179,431 | 4/1965 | Pikl | 280/5.2 |
| 3,196,970 | 7/1965 | Brenner | 180/8.2 |
| 3,226,128 | 12/1965 | Grier | 280/5.2 |
| 3,241,848 | 3/1966 | Florey | 280/5.26 |
| 3,269,478 | 8/1966 | Joslyn | 180/8.2 |
| 3,438,641 | 4/1969 | Bradley | 280/5.28 |
| 3,573,877 | 4/1971 | Locke | 280/5.32 |
| 3,592,282 | 7/1971 | Soileau | 280/5.28 |
| 4,326,622 | 4/1982 | Elzey | 198/322 |
| 4,421,189 | 12/1983 | Watkins | 180/8.2 |
| 4,432,425 | 2/1984 | Nitzberg | 180/8.2 |

FOREIGN PATENT DOCUMENTS

| | | | |
|---|---|---|---|
| 7604846 | 11/1977 | Netherlands | 280/5.3 |
| 1069810 | 1/1984 | U.S.S.R. | 280/DIG. 10 |

*Primary Examiner*—John A. Pekar

*Attorney, Agent, or Firm*—Seed and Berry

[57] ABSTRACT

The invention is an apparatus or wheelchair of conventional doorway width capable of negotiating stairways, turning about landings as necessary. The chair includes an outer supporting assembly, preferably the normal transport wheels, and an inner supporting assembly or feet. The chair includes mechanisms for elevating the supporting assemblies, in turn, while the other assembly supports the weight of the chair. The elevating mechanism is connected to the chair seat such that, upon elevation of a supporting assembly, the chair elevates also. The elevated assembly is articulated and advanced on horizontal slide bearings into contact with the stairs, with supporting elements resting on both lower and upper stair treads. The chair and occupant are then advanced on horizontal slide bearings over the new supporting assembly. The elevating mechanism then transfers chair weight to the new supporting assembly and elevates the former supporting assembly. The operation is repeated, alternating between the supporting assemblies, until the stairs are climbed.

15 Claims, 20 Drawing Figures

STAIR-CLIMBING WHEELCHAIR

DESCRIPTION

1. Technical Field

The field of the invention is an apparatus capable of climbing and negotiating stairways and curbs. Particularly of interest are wheelchairs which enable an occupant-operator to climb stairways.

2. Background Art

There has long been an interest in wheelchairs capable of climbing stairs and curbs as a means of imparting greater mobility and hence self-sufficiency to chair-bound persons. For example, Bray, in U.S. Pat. No. 468,022, in 1892 described such a chair. Bray employs levers and screws to raise the wheels off the ground and then pairs of jacks to lift the chair up vertically and a horizontal rack-and-pinion arrangement to advance the chair horizontally. A difficulty with the Bray arrangement is that the center of gravity of the chair as it advances is often such that the operator is in a precariously balanced position. This is especially risky in view of Bray's jackscrew clamping means that utilize unsafe set screws. Also, the height to which it is necessary to jack the chair is such that the mechanism necessary is so bulky that it must be exterior to the wheels of the chair. The resulting chair is wider than a conventional wheelchair, causing difficulty in negotiating the wheelchair through doors. The chair also lacks any means of turning landings, limiting its mobility and usefulness.

During the early 1960's, a great deal of interest in stair-climbing wheelchairs was generated among inventors by a design contest sponsored by the National Inventors Council and the President's Committee on the Employment of the Physically Handicapped. The contest was in recognition that no practical stair-climbing wheelchair existed.

Examples of the designs developed during this period are shown in Grier, U.S. Pat. No. 3,226,128, and Joslyn, U.S. Pat. No. 3,269,478.

Grier utilizes fore-and-aft skids attached to the chair drive wheel axles interior to the wheels. A gripping means holds the chair on the stairs while the skids move the chair up the stairs, with the skids resting on the noses of the stairs at intervals. The operation is susceptible to slippage and again puts the operator in various precariously balanced positions.

Joslyn, in U.S. Pat. No. 3,269,478, describes a pair of vertically oriented, hydraulically operated lifting legs fore and aft, on each side of the chair, which are pivoted at their top ends on the chair and interconnected to each other. The cylinders lift the chair, and swinging about the pivots, advance the chair up a stair, where it rests on chair-leveling feet. The lifting cylinders are then retracted and advanced another stair, and the operation repeated until the stairs are negotiated. As in Bray, the mechanisms are relatively large and awkward, and must be attached exterior to the wheels, resulting in a chair that is extra wide and thus of limited utility.

DISCLOSURE OF THE INVENTION

It is an object of the invention to provide a wheelchair that enables an occupant-operator to climb curbs and stairways easily. The chair is of a width that it may easily negotiate conventional doorways and stairways. The chair is capable of turning about landings as necessary. A principal object of the invention is to provide a chair that ensures that the operator is always adequately supported without danger of upset during the stair-climbing operation, in contrast to prior art chairs.

The stair climbing wheel chair comprises three major assemblies, including a chair seat assembly and two seat supporting assemblies. An outer support assembly, consisting of two separated structures, supports opposite sides of the seat assembly. Preferably, the outer support assembly comprises wheels on either side of the chair. An inner support assembly, closer to the centerline of the chair, also supports the seat assembly.

Each of the seat supporting assemblies are attached to the chair seat assembly in a manner which permits each to move independently of the other in a horizontal direction, forward or backward relative to the chair seat. The chair operator releases latches and powers this movement, as will be described below.

The chair seat assembly also includes a means for raising and lowering the attached seat supporting assemblies vertically. The arrangement is such that as one supporting assembly is raised, the other assembly is lowered, making it possible to shift the weight of the chair seat and occupant from one supporting assembly to the other and at the same time raise the unloaded supporting assembly to a higher elevation, as in climbing stairs. In so doing, the arrangement further provides that the chair seat assembly is also raised in elevation, one-half that of the raised supporting assembly. A means that locks the supporting assemblies and thus the chair seat assembly in any elevated position is included.

The two seat supporting assemblies each have a plurality of "feet" at their lower extremities for contacting supporting surfaces either on the same level or at differing elevations when on stairs. In the case of the preferred wheelchair outer support assembly, the "feet" are the wheelchair wheels. The feet or wheels, once elevated, are, upon release of a locking mechanism, pivotable vertically, thus elevating the pair of feet nearest the stair to be climbed, while the other pair of feet moves downward into contact with a lower supporting surface. The feet or wheels are spaced far enough apart to provide longitudinal and lateral stability to the chair and occupant.

Approximate manual adjustment of the feet to accommodate change from a level floor to that of the floor and the first step tread, at the same time maintaining the chair in a level position, is executed when a supporting assembly is in a raised, unloaded position. The feet are unlocked and the fore and aft feet are then free to pivot vertically with respect to each other. The feet are then lowered into contact with the surfaces, continuing to pivot until all are in contact with either level floor or the first stair tread. At this time, as the weight of the chair is transferring to the contacting feet, a gravity actuated locking mechanism locks the chair in the level position in relation to the supporting feet, forming a rigid structure supporting the seat assembly. The means for adjusting the level of the chair as a whole, in relation to its supporting feet, noted above and discussed in more detail below, is incorporated as part of the gravity actuated feet locking mechanism aforementioned.

An advantage of this invention is that the wheels, which support and transport the chair on level surfaces, preferably comprise the outer seat supporting assembly. This eliminates the need for a separate outer supporting structure and means for retracting the wheels when climbing the stairs. Thus, the two driving wheels and two caster wheels, typical of many wheelchairs, become the feet of the outer seat supporting assembly. A means of locking the driving wheels from turning while climbing stairs is provided.

Another feature of this invention includes an inner seat support assembly having, as supporting elements or feet, rollers mounted on axles longitudinal to the chair. These rollers permit the chair to be moved sidewise when the chair is supported on these rollers. This arrangement allows the operator to push the chair away from a wall or stair railing should it inadvertently become too close.

Yet another part to this invention is a vertical pivot axis connecting the inner chair seat supporting assembly with the chair seat assembly. This connection allows the chair seat assembly and attached outer chair seat supporting assembly to be rotated to a new azimuth orientation during the interval that the inner supporting assembly is supporting the chair. A means for supplying the necessary force and control for this operation is included. This mechanism provides a means for following curved stairways and making the sharp turns quite often necessary on landings.

The chair seat assembly preferably includes a chair seat fastened on each side to substantially the midpoint of a pair of parallel elevating levers. Each end of each lever is pivotally fastened to horizontally oriented slide bearings, two on each side of the chair. Each linear slide bearing on each side of the chair includes an outer race slide and an inner race slide. Each outer race slide is pinned to the ends of the elevating levers such that the outer slides may be adjusted vertically with the slide always remaining substantially parallel to the chair seat. The outer slides are pinned on opposite sides of the elevating levers such that with respect to the chair center line, there is an outer, or first, slide bearing and an inner or second slide bearing.

As discussed above, an outer supporting assembly may include supporting and transporting wheels fore and aft, with respect to the chair. These wheels are mounted on a frame pivotally attached to a vertical post which is fixed by connecting members to the horizontal inner slides of the first slide bearing. The connection is such that the chair may be supported by the wheel groups articulated about the pivot, with some of the wheels in supporting contact with the one tread or surface and some in supporting contact with another tread or surface at a different elevation. An inner supporting assembly includes groups of feet or rollers supporting means fore and aft with respect to said chair for intermittently supporting the chair. A frame supporting the feet is pivotally attached to a vertical post which is fixed by connecting structures to the horizontal inner race slide of the second slide bearing. The feet may be articulated in the vertical direction about the pivot such that the chair may be supported by the feet with the feet articulated, as in the manner of the wheel assembly. The chair also includes means for adjusting the elevation of the outer races with respect to each other, whereby the wheels and feet may be adjusted between a chair-supporting position and a height greater than the risers of stairs normally encountered. A locking means is provided to lock the wheels or feet assemblies into a chair-supporting position, with the chair level while the wheels or feet are either level or articulated into contact with treads or surfaces at typically different elevations.

BEST MODE FOR CARRYING OUT THE INVENTION

Figure 1:
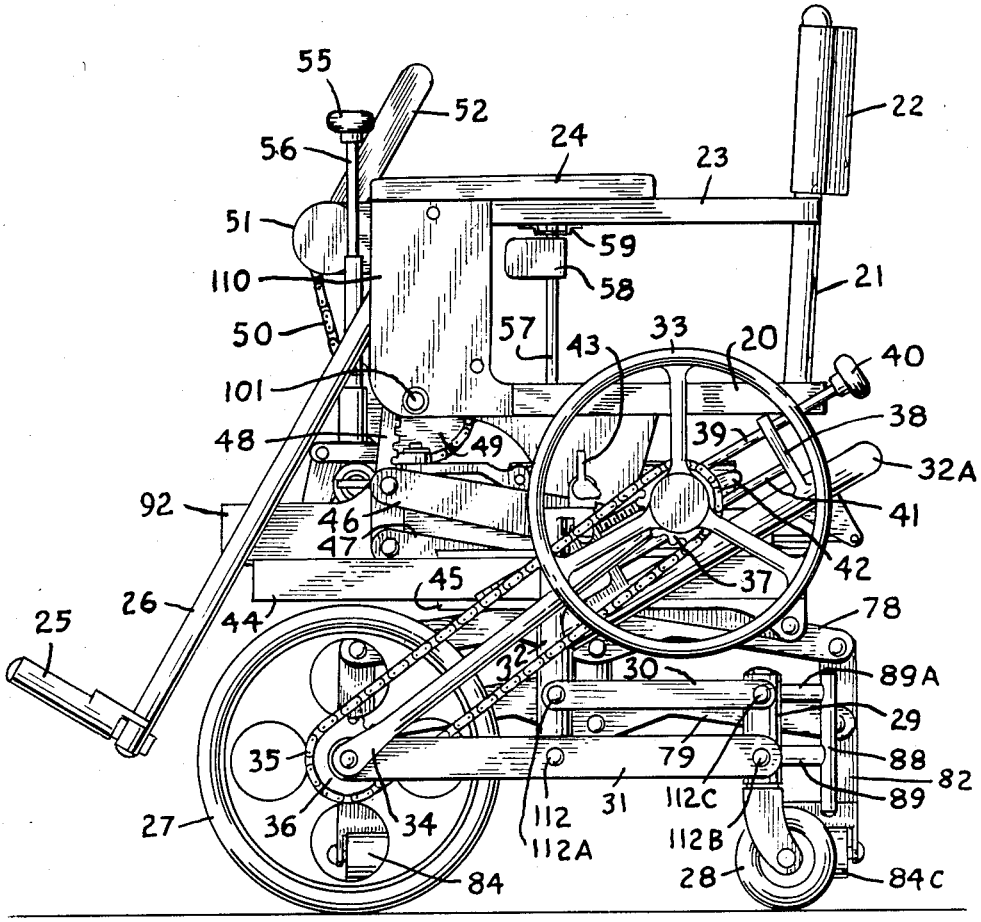
FIG. 1 is an elevational view of the wheelchair of the invention positioned for traveling on level surfaces.
Figure 5:
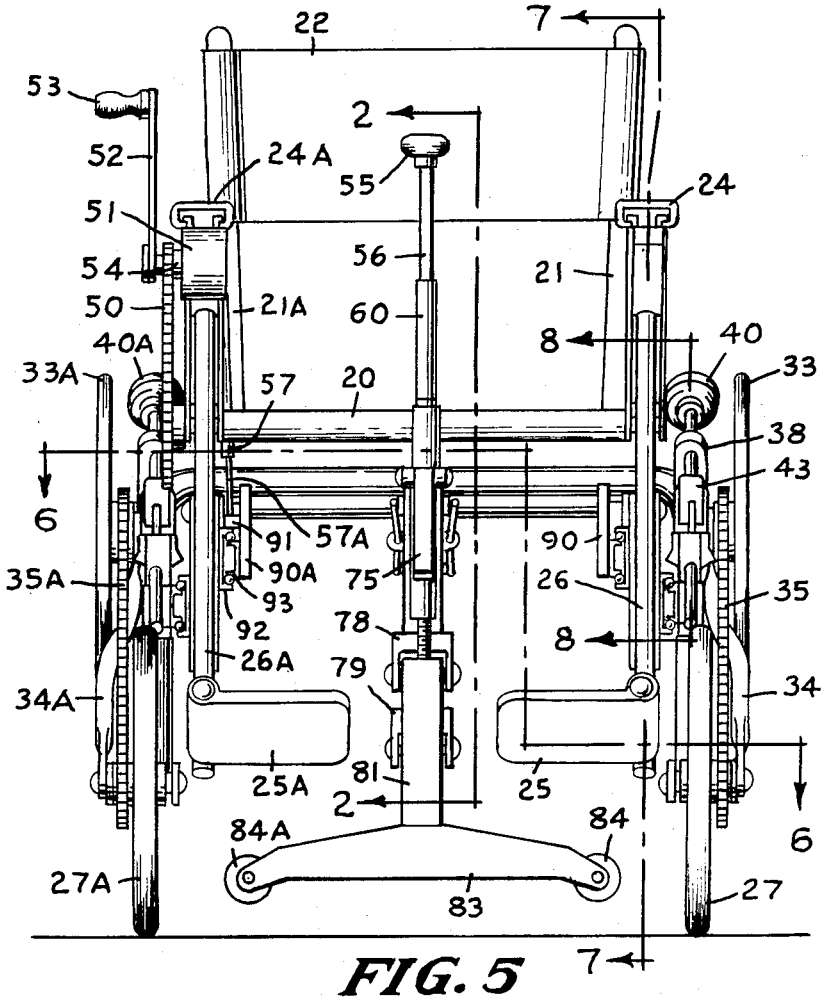
FIG. 5 is a front elevational view of the chair, with the inner feet supporting means elevated.
Figure 7:
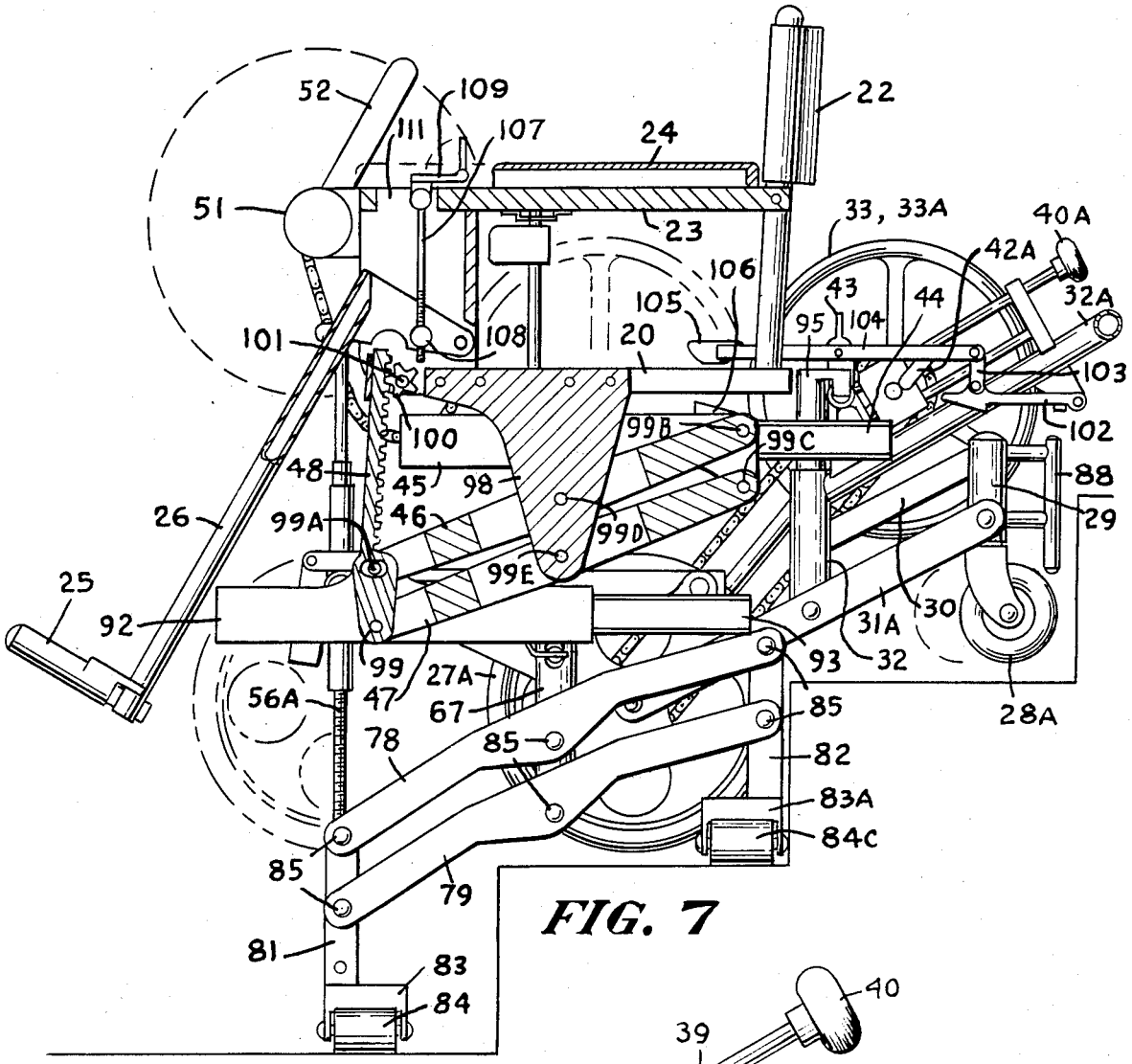
FIG. 7 is a sectional view along section line 7 in FIG. 5 showing the chair at maximum elevation and the supporting wheels extended back for climbing up stairs.

Referring to FIGS. 1, 5 and 7, the wheelchair consists of a seat 20 with a back 22, armrests 24, 24*a*, and adjustable footrests 25, 25*a*. The seat 20 is supported at all times by either or both an outer supporting assembly including a set of wheels or an inner supporting assembly including a set of inner feet supporting means. Two drive wheels 27, 27*a* and two caster wheels 28, 28*a* make up the outer set of supporting means. A pair of handwheels 33, 33*a* provide a means for the occupant to propel the wheelchair during normal use. Movement of the handwheels is transferred directly to the drive wheels by sprockets 36, 37 and chains 35, 35*a*. Four rollers 84, 84*a*, 84*b* and 84*c* make up the inner set of supporting means. Both sets of supporting means are adjustable vertically relative to the seat and are arranged so that as one set is moved downward relative to the seat, the other set is moved upward. The inner supporting assembly is pin connected, as described in more detail below, through slide-bearing means 92, 93 to one end of a set of paralleling levers 46, 47. As shown in FIG. 7, the outer supporting assembly including a set of wheels 27*a*, 28*a* is connected to a slide bearing 44, 45 which is pin connected to the other end of the paralleling levers 46, 47. The levers 46, 47 are pivotally connected at their midpoint to a bracket 98 attached to the seat 20, as shown in FIG. 7. The lever arrangement is such that where one set of supporting elements, either wheels or feet, is resting on the ground and the other set is elevated, the seat will also elevate relative to the ground, but only one-half as much as the elevated supporting set.

The energy to raise and lower the sets of feet or wheels, and thus the seat and occupant of the chair, is supplied by a handcrank 52, 53, as shown in FIGS. 1, 5 and 7. The crank 52 is connected to the input shaft of an irreversible drive 51, not shown in detail but of the type, for example, as shown in U.S. Pat. No. 3,237,735, hereby incorporated by reference. As shown in FIGS. 1 and 5, output sprocket 54 transfers its motion through chain 50, to sprocket 49, which drives cross-shaft 101, which has two pinions 100, 100*a* on either side of the chair. These pinions 100 drive two racks 48, 48*a*, which are connected by pins 99, 99*a* to levers 46, 47 and the outer race slides 92 of the linear bearings. The outer race slides 92 support inner races slides 93 that are connected to the inner supporting assembly and feet means 84.

The output sprocket 54 is always prevented, by means of the irreversible drive 51, from rotating, except when driven by the crank input 52. The irreversible drive 51 serves to hold the chair at any height that it is cranked to and leaves the operator's hand free, except when cranking. The direction of rotation of the adjusting means crank 52 determines which set of supporting means, the feet or wheels, will be raised. Clockwise rotation, as seen in FIGS. 1 and 7, will raise the inner set of feet, while counterclockwise rotation will raise the outer wheel set.

The wheels and feet supporting means are movable horizontally, parallel to the seat, by means of pairs of ball-bearing-type linear bearings, including slides 44, 45 and 92, 93, respectively, as shown in FIG. 7. Horizontal movement of each set of supporting means is independent of any movement of the other set.

A first pair of linear bearings, one adjacent each side of the chair, includes outer slide bearing races 45 and inner slide bearing races 44. One end of the parallel elevating lever bars pair 46, 47 is pivotably fixed by pins 99*b*, 99*c* to the outer race 45. The inner race 44 is connected by post 95 and bracket 98 to a vertical supporting member 32 to which a frame means is pivotably pinned, described further below and shown in FIGS. 1, 7, 8 and 9, upon which frame the wheels 27, 28 are mounted.

A second pair of linear bearings, also one adjacent each side of the chair, includes inner slide bearing races 93 and outer slide bearing races 92. The opposite end of the elevating levers pair 46, 47 is pivotably fixed by pine 99, 99*a* to the outer race 91, 92*a*. The inner race is fixed by structural members, as detailed below, to a vertical supporting member 67 upon which a frame 78, 79, 81, 82, 83 and 83*a* is mounted and to which the feet 84, are pivotably fixed by pins 85.

The wheels 27, 28 can be moved horizontally from a position alongside the seat to a distance rearward to accommodate the maximum anticipated tread width of the stairs. The wheels on each side of the chair are tied together through a frame member 32*a* so that the wheels on both sides of the chair move simultaneously. The wheels are normally restrained from moving back by latch 102, shown disengaged in FIG. 7, latched to lug 106. The wheels 27, 28 are moved rearward by disengaging the lock 102 by depressing a lock pad 105 and then pushing handwheels 33, 33*a* rearward. The entire wheel assembly 27, 28 slides rearward on the linear ball-bearing inner race slides 44, 44*a*, as shown in FIG. 7. Horizontal movement of the wheels 27, 28 is only possible when they are in the raised position.

Figure 6:
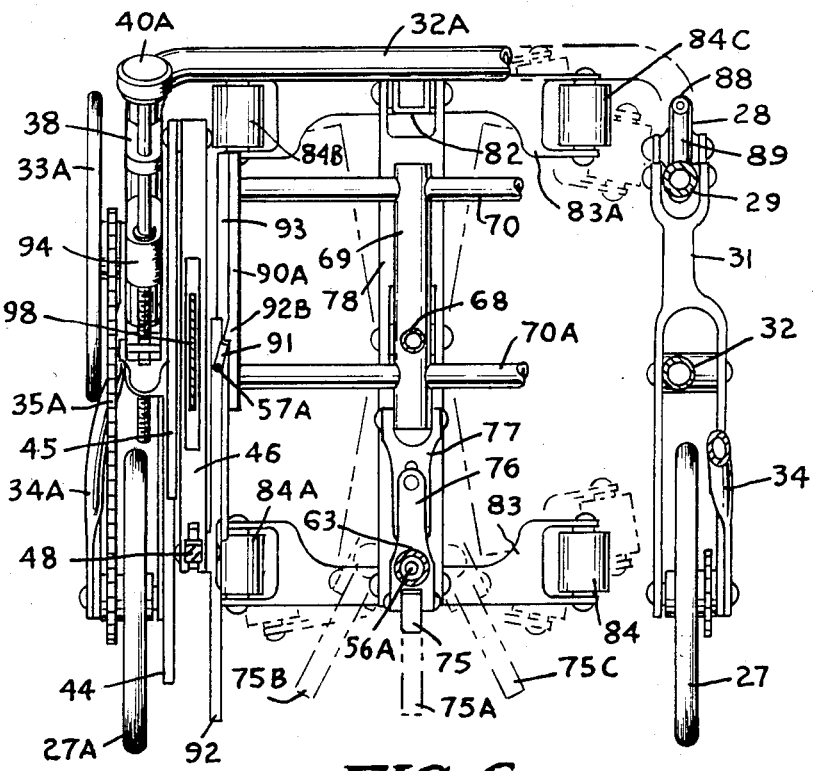
FIG. 6 is a plan view of FIG. 5 taken along sectional line 6.

The inner feet 84 can move from a position centered under the seat to a position a distance forward of the chair. This movement is normally restrained by latch 91 engaging lug 92*b*, which is an element of a slide mounting plate 90, 90*a* connected through supporting frame members 70, 70*a* to the feet 84, as shown in FIG. 6. When the inner feet are in a raised position, the latch 91 is released by depressing a lever 58, as shown in FIG. 1. The lever 58 is connected to latch 91 by a square tube driving a square rod which telescopes inside it and is connected to the latch. It is biased in the latched position by means of a torsion spring. As the latch is released, the inner feet are moved forward by pushing on a joy stick knob 55. The inner feet 84 assembly advances on linear ball-bearing races 93, 93*a*, as shown in FIGS. 5 and 6.

Figure 2:
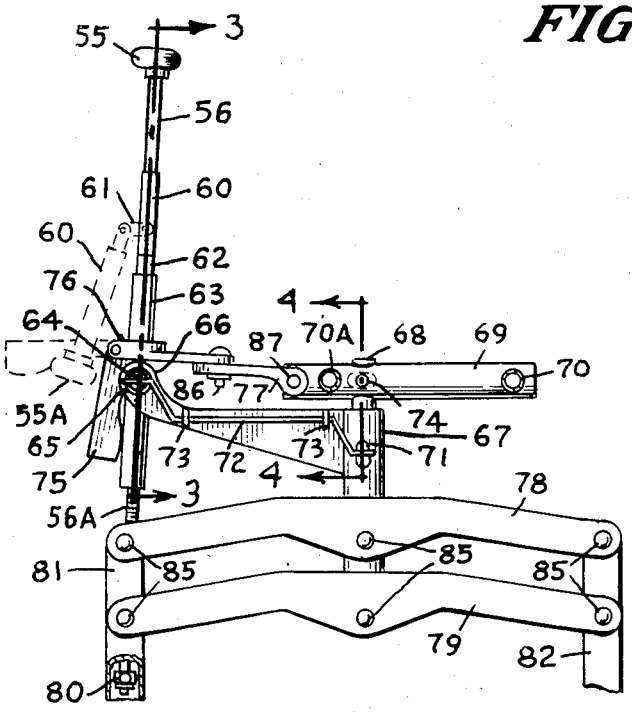
FIG. 2 is a view of the inner supporting feet and frame means.

As shown in FIGS. 1–2 and 7, both the inner feet 84 and the wheels 27, 28 have the capability of pivoting vertically about their supporting post members 32, 67, which are connected by shown members to the horizontal inner slide portions of their respective slide bearings 93, 44. The structure allows articulating each set of either wheels or feet in the vertical direction about the pivots 112 or 85, respectively. The articulation permits either the wheels or feet to support the chair in a level position when climbing stairs. Thus, for example, as shown in FIG. 7, the feet 84 are articulated about pivots 85 such that a pair of feet 84, 84*a* partially supports the chair on the level ground while a second pair of feet 84*b*, 84*c* partially supports the chair on the tread of the first elevated stair.

Figure 3:
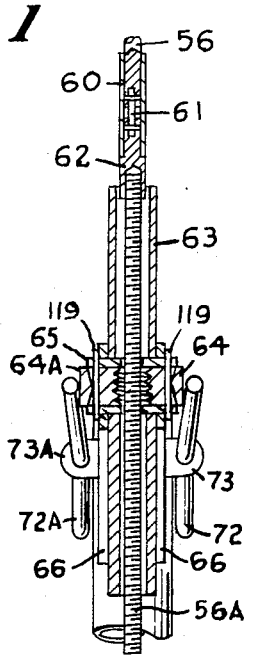
FIG. 3 is a sectional view of FIG. 2 showing locking means for securing the feet means in an articulated, chair-supporting position.
Figure 4:
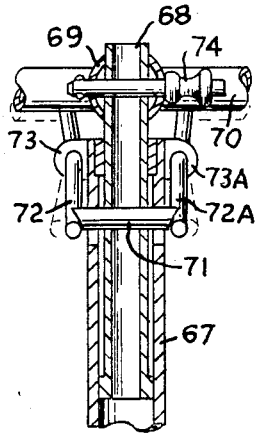
FIG. 4 is a sectional view of the means for actuating the locking means of FIG. 3.

Pin joints 85, connecting the support beams 78, 79, the legs 81, 82 and the central support housing 67 permit articulation with respect to the feet supporting means. The arrangement is stabilized, or locked into place, after articulation, by means of a threaded attitude-control rod mechanism, shown in FIGS. 2–4 and 7. Control rod 56*a*, which is threaded, is locked between two half nuts 64 and 64*a*, as shown in FIGS. 2 and 3. These half nuts are retained in sleeve 65 fastened to the structure 66, which is rigidly fastened to the central post housing 67. The half nuts 64, 64*a* lock on the threaded rod only when the four feet 84 are resting on solid footing and at least some of the weight of the chair is transferred by the control post 68 to the central support housing 67. The nuts are ordinarily held away from the threaded rod by means of a spring element 119, as shown in FIG. 3. The post 68 is free to move in the housing 67 a short distance vertically as weight is applied and transfer this motion via wedge pin 71 to the locking levers 72, 72*a*. The wedge pin also acts as a retainer for the central post and operates the levers by extending through slots in the housing 67, as shown in FIG. 4. The half nuts 64, 64*a* are held in an open position by a spring 119 when the inner feet are in the raised position. In this position, the front and back feet can be moved up and down relative to each other manually, by pushing on knob 55, or they will automatically adjust to a surface upon which they are lowered. In the latter case, as they are lowered, the central support housing is held vertical by the elevation-adjusting mechanism and slide bearings. When the feet are carrying some of the weight of the chair, the half nuts 64, 64*a* lock onto the threaded control rod 56*a*. Consequently, the attitude of the supported chair is secured in a level position.

If, for any reason, the chair should become out of level, it can be easily adjusted while resting on its inner feet by turning knob 55, which turns the threaded rod 56*a* through the half nuts 64, 64*a*. The rod 56*a* is anchored against longitudinal movement to the leg 81 by trunnion 80, as shown in FIG. 2. Turning the rod moves the half nuts, which changes the level of the chair.

Substantially the same system of using half nuts locking onto a threaded rod is used to maintain articulated stability of the wheel set when the wheels 27, 28 are supporting the chair. This requires identical locking systems, however, on each side of the chair, which, in this case, are combined with an arrangement for maintaining a constant tension on the chains 35, 35*a* between the handwheel sprockets 37, 37*a* and the drive wheel sprockets 36, 36*a*.

Figure 8:
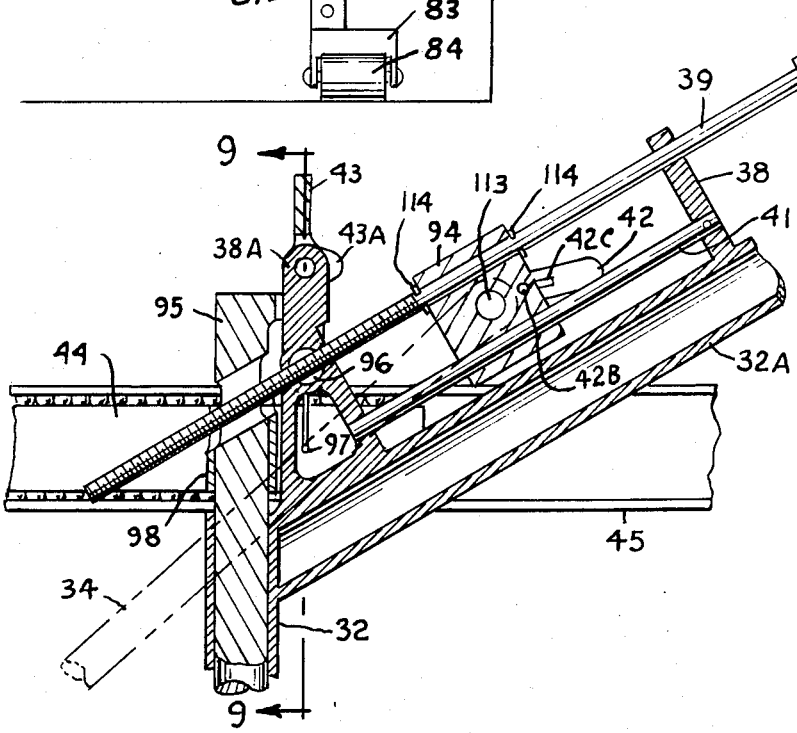
FIG. 8 is a sectional view of the means for adjusting and locking the wheel means, taken along sectional lines 8 in FIG. 5.
Figure 9:
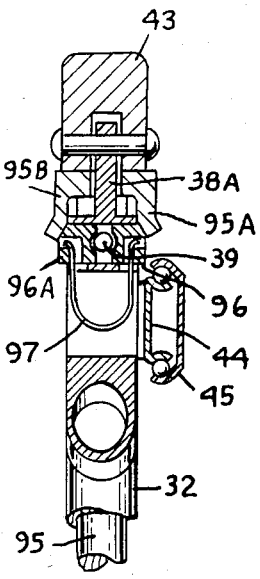
FIG. 9 is a sectional view of the adjusting and locking mechanism of FIG. 8.

FIGS. 8 and 9 show longitudinal sections taken through the chair attitude locking system. Block 94 is used to hold the axle 113 on which the handwheels 33, 33*a* are mounted and also as a movable anchor for the chain tension brace 34. Block 94 is guided by rod 41 and also by a partially threaded control rod 39. Snap rings 114 prevent the block from sliding relative to the rod so that when a pair of half nuts 96, 96*a*, as shown in FIGS. 8–9, are closed on the threaded rod, the block is locked in place. Locking the rod in place locks in the attitude of articulation of the wheels at the moment that the half nuts engage the threaded rod. The half nuts are wedged into the locked position by ears 95*a*, 95*b*, FIG. 9, which are extensions of 95, a cylindrical rod which slides into the main frame vertical post 32. Rod element 95 is rigidly fixed to the inner race of slide 44 by bracket 98, as shown in FIG. 8. A slot in the upper end of 95 allows it to move vertically a small amount without disturbing the articulation-adjusting rod 39. Vertical motion of the rod 95 is caused by load reversals between when the wheels are supporting the chair and when the chair is supported by the feet. A spring 97 holds the half nuts apart when the wheels are raised. This allows the wheels to be articulated manually by pushing or pulling knobs 40, 40*a* in FIG. 8. Rotating the knobs 40, 40*a* when the wheels are supporting the chair and the half nuts are closed allows minor leveling of the chair, if necessary.

Where risers for each step are uniform, and after the outer wheels have been adjusted to the height of the first step, it is often an advantage to lock the automatic articulation control rod 39. The articulation control 39 can be locked in place by rotating lever 43 so that lobe 43*a*, as shown in FIG. 8, restrains 95 from moving upwards and unlocking the half nuts 96, 96*a*.

The caster wheels 28, 28*a* are mounted in a vertical axis post 29, as shown in FIGS. 1 and 7. Paralleling link 30 and frame member 31 maintain them in a vertical position so that the caster wheels can properly carry their share of the weight. Bumpers 88 are mounted rigidly to the vertical axis member 29 by supports 89, 89*a*. The bumpers prevent the caster wheels from getting caught under a projecting step or the like.

Figure 11:
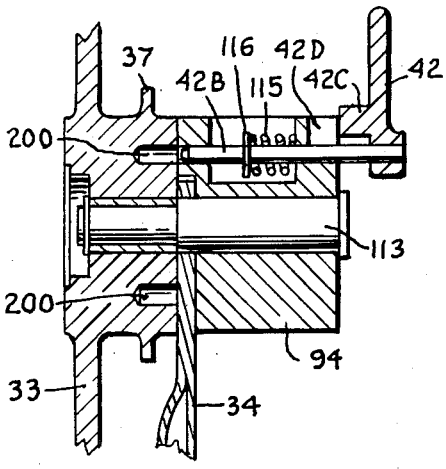
FIG. 11 shows a mechanism for locking the handwheels, preventing rotation.

When the wheels 27, 27*a* are supporting the chair on a stairway, they must be locked to prevent the chair from rolling. FIG. 11 shows handwheel 33 provided with a number of locking slots or holes 200 machined into wheel sprocket 37. Lug 42*c* on lever 42 is permitted to drop into notch 42*d* when the lever is rotated about the axis of pin 42*b* into correct alignment. This allows the pin 42*b* to be extended by spring 115 pushing against snap ring 116 into one of the holes 200 in the hub of wheel 33.

Figure 10A:
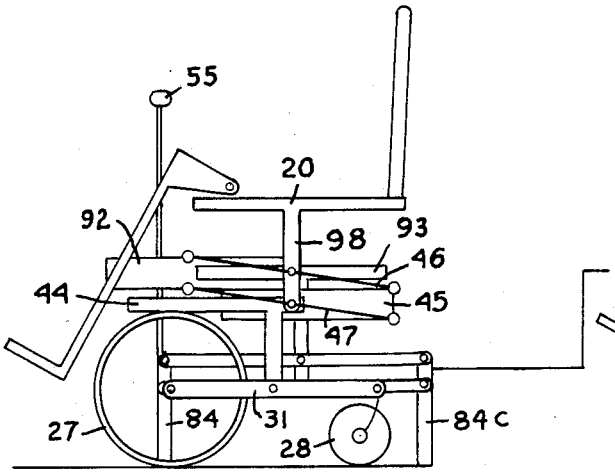
FIGS. 10*a–e* show the wheelchair in operation climbing a set of stairs.

The wheelchair of the invention is shown in its principal parts in operation climbing stairs in FIGS. 10*a*–10*e*. In FIG. 10*a*, the chair, supported and propelled by its wheels 27, 28, is backed up to the first step. The inner feet 84, 84*c* are lowered by turning the handcrank 52 (where not shown in these views refer to earlier discussion) counterclockwise so that the chair is resting on both its inner feet 84, 84*c* and wheels 27, 28.

Figure 10B:
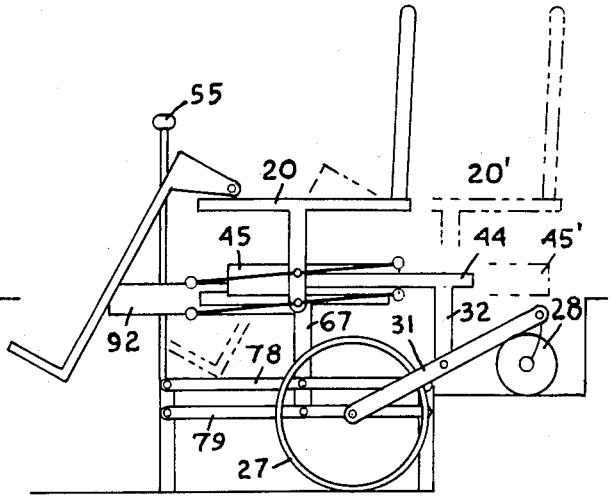

Referring to FIG. 10*b*, the wheels 27, 28 are raised enough, by continuing to turn the handcrank 52, that by tilting the support arm 31, caster wheel 28 will clear the step and allow the wheel assembly to be slid back, after releasing latch 102, on linear slides 44, 45 into position 45' with the caster wheel resting on the first step tread and the drive wheel resting on the level surface. Once the wheels clear the ground, they are locked from rotation by adjusting the wheel-locking lever 42, 42*a*. The seat 20, after locking lever 58 is released, is then slid back, by pushing on the control knob 55 with one hand and pulling on the handwheel 33 with the other, toward the stairs to position 20' until a locking latch 102 engages a lug 106. The chair is now supported by the wheels 27, 28.

Figure 10C:
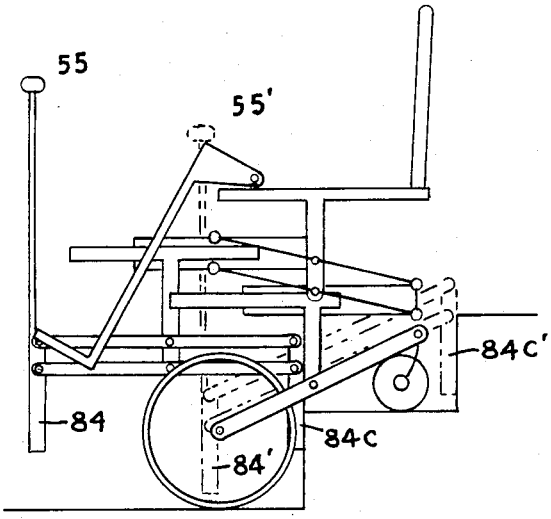

Referring to FIG. 10*c*, the inner feet 84, 84*c* are raised by turning the crank 52 clockwise. Knob 55 is depressed, which lowers 84 and raises 84*c* sufficiently to allow them to slide toward the stairs to a position 55', 84', 84*c'* wherein latch 91 engages lug 92*a*. The feet are lowered into supporting contact with the first tread and the initial level surface. The locking mechanism described previously locks the feet in their articulated position for supporting the chair.

Figure 10D:
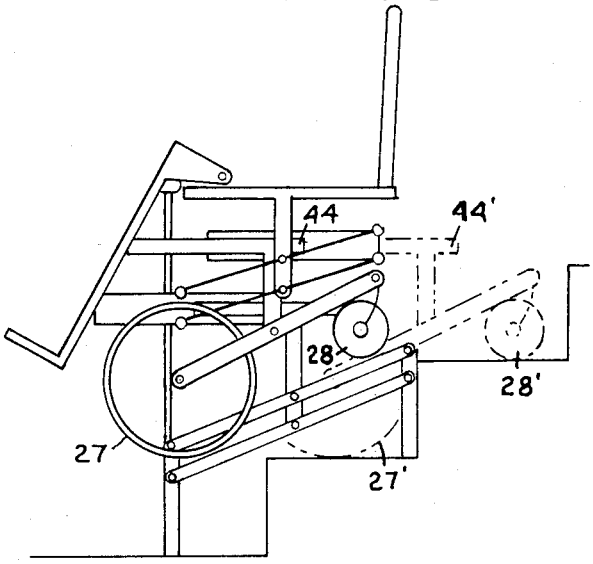

Referring to FIG. 10*d*, the wheels 27, 28 are elevated and slid toward the stairs to new positions 44', 27', 28'. The chair is then positioned over the wheels, as shown in FIG. 10*b*. The remaining steps are climbed by the sequence of raising the inner feet and moving them back, raising the outer feet and moving them back, and moving the seat back.

Figure 10E:
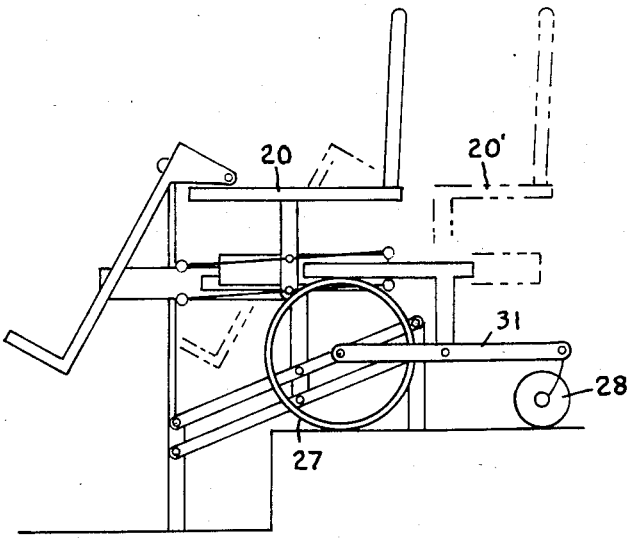

FIG. 10*e* shows that once the top of the steps has been reached, the support arm 31 is level once again, allowing the wheels 27, 28 to support the seat 20 as it moves to position 20'.

Descending the stairs is done by reversing the above-described steps.

The rollers 84, 84*a*, 84*b* and 84*c* allow the chair to be moved sidewise on the stairs by the operator pushing the chair away should it get too close to a handrail or wall.

It is often necessary to turn the chair, with the drive wheels remaining locked, while climbing stairs. This is necessary on landings between flights of stairs and to follow a curved stairway. Referring to FIG. 6, a steering handle 75 is elevated, which unlocks the fulcrum link 76. With the weight of the chair resting on the wheels, the handle at 75*a* is moved to 75*c* or 75*b*. The inner feet turn, as shown in FIG. 6 by means of the phantom lines. If the inner feet are supporting the chair and the handle is moved as noted, the whole chair and wheels rotate about the axis of center post 68. By alternatively shifting chair weight from the feet and turning, and then to the wheels and turning, the chair can turn any amount necessary.

The articulating control mechanism for the feet 55 is used normally only when climbing stairs or curbs with the chair. When it is not needed, it is folded down into position 55*a* to facilitate getting in and out of the chair or when traveling on wheels as described above. It is folded down by sliding a sleeve 60 upwards, which allows it to fold at a double-jointed link 61.

The footrest 25 can be raised or lowered by a crank 109, normally hidden under sliding armrest pads 24, 24*a*. Turning the crank 109 turns a threaded rod 107 in a pivoted nut 108 fixed to an armrest support 111, which moves the footrest elements 25, 26, as shown in FIG. 7.

When there are long periods of time when it is known that stairs will not be climbed, the inner feet assembly can be removed by removing pins 74 and 86, as shown in FIGS. 2 and 4. This would considerably reduce the weight of the chair.

Figure 12A:
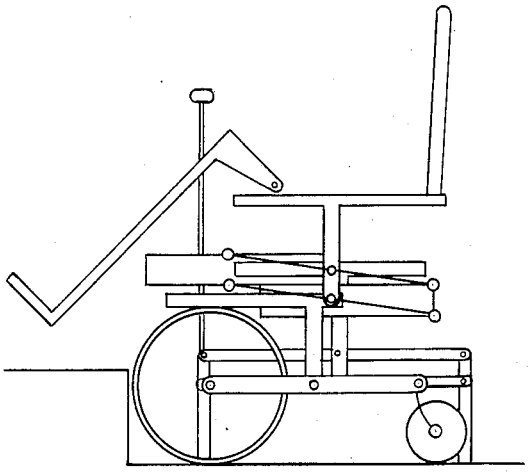
FIGS. 12*a–d* show operation of the wheelchair in climbing a curb.
Figure 12B:
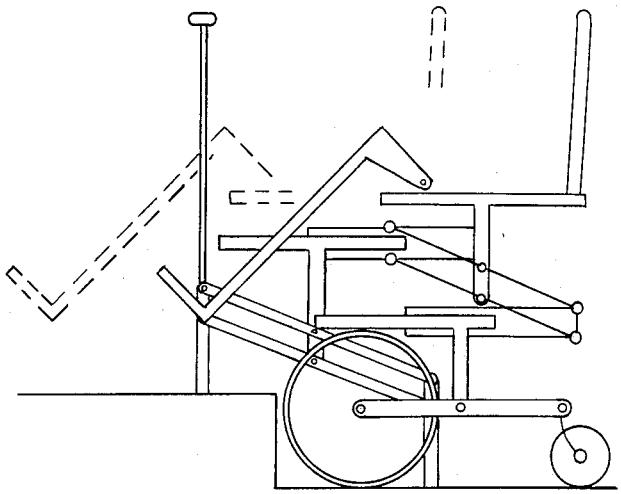
Figure 12C:
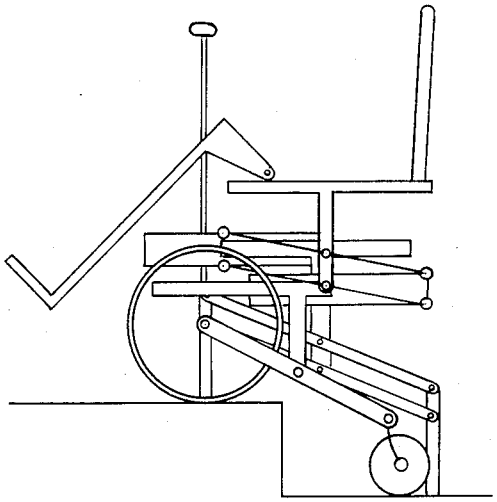
Figure 12D:
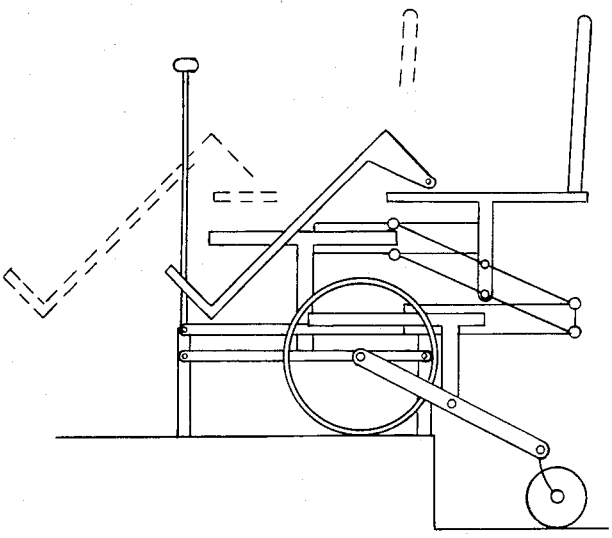

Referring to FIGS. 12*a–d*, a schematic representation is shown of the sequence of movements of the chair surmounting a curb while moving in a forward direction. In FIG. 12*a*, the chair approaches the curb with footrests raised. FIG. 12*b* shows the inner feet raised, articulated and moved forward and secured in a wheelchair-supporting position. Dotted lines show the seat assembly moved forward. FIG. 12*c* shows the wheels raised, articulated, and moved forward and in a wheelchair-supporting position. FIG. 12*d* shows that the inner feet have been elevated articulated, and moved to a level position forward and are now in a wheelchair-supporting position on the top of the curb. The chair seat assembly is advanced and the wheels are raised, leveled and advanced and adjusted to a supporting position. The inner feet are then raised and the curb has been surmounted and the chair is ready to travel again on its wheels.

Figure 13:
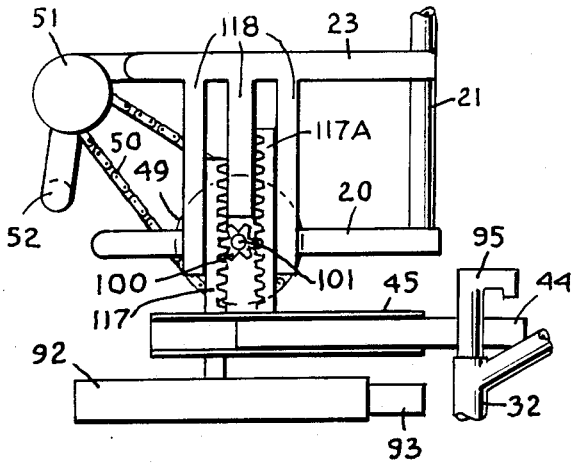
FIG. 13 shows an alternative measure of raising and lowering the outer races of said chair.

FIG. 13 shows an alternate system for obtaining the vertical movement of the inner and outer feet. Racks 117 and 117*a*, on each side of pinion 100, replace the paralleling levers 46 and 47. Rack 117 is rigidly fixed to the outer slide race 45. Racks 117 and 117*a* are guided in vertical movement by guides 118 which are firmly mounted to the seat 20 and arm rest 23. There is a like system of pinion, racks and guides on each side of the chair. The pinions on each side of the chair are keyed to the cross shaft 101 which passes through and is journaled to the seat 20. A sprocket 49 and chain 50, transfer the rotary motion of the crank 52 to the cross shaft. For a given direction of rotation of the crank 52, rack 117 will be driven in one direction and rack 117*a* will be driven in an opposite direction. This accomplishes the same thing as the paralleling levels 46 and 47.

It will be obvious to those skilled in the art that various mechanisms could be substituted for those described in the preferred embodiment. It is not intended that the invention be limited to a single mechanism but that it include all those which are obviously equivalent. For example, in some anticipated applications of the invention it may be advantageous that the range of horizontal movement of both inner and outer supporting assemblies be equally far both forward and aft of the chair seat. With greater length linear bearings, a stair climbing machine can be built that will climb stairs a full step at a time instead of a series of half step rises as described above. Such structures may be suitable for robotic machines where function and structure permit.

I claim:

1. A wheelchair for climbing stairs and curbs, comprising:

a chair seat;

paralleling elevating levers adjacent each side of said chair, said levers including a plurality of parallel bars substantially horizontally oriented, said chair fastened to said lever bars, whereby the levers are free to pivot vertically in parallel abut said chair fastening while the chair seat remains always substantially horizontal;

a first pair of linear bearings, one adjacent each side of said chair, said bearings having an outer race slide to which one end of said parallel lever bars is pivotably fixed such that said bearings remain substantially horizontally oriented parallel to the chair seat, and an inner race slide connected through a vertical support member to a first frame means, vertically pivotable about said connection, upon which are mounted a plurality of wheelchair-supporting and transporting wheels, which frame, upon pivoting causes vertical articulation of said wheels, whereby said chair may be supported in a level position with some of the wheels resting on one stair tread or surface and others on another stair or surface at a different elevation;

a second pair of linear bearings, one adjacent each side of said chair, said bearings having an outer race slide to which the opposite end of said parallel lever bars is pivotally fixed such that said bearings remain substantially horizontally oriented parallel to the chair seat, and an inner race slide connected through a vertical support member to a second frame means, vertically pivotable about said connection, upon which are mounted a plurality of chair-supporting feet means, which frame, upon pivoting, causes vertical articulation of said feet, whereby said chair may be supported in a level position with some of the feet resting on one stair tread or surface and with others on another stair or surface at a different elevation;

means for adjusting the height of said wheels, while said feet support said chair, between a chair-supporting position and an elevation at least one stair riser high;

means for locking said elevated wheels in a position when said wheels are articulated substantially to the slope of said stairs;

means for adjusting the height of said feet, while said wheels support said chair, between a chair-supporting position and an elevation at least one stair riser high; and means for locking said elevated feet in a position when said feet are articulated to substantially the slope of said stairs, wherein stairs are climbed by backing said wheelsupported wheelchair up to the bottom stair of said stairs, adjusting said feet downwards to support said chair, adjusting the wheels upwards more than one-half a stair riser in height, whereby said chair is elevated about one-half that of the wheels by operation of said elevating levers connected through slide bearings and frame to said wheels, articulating said wheels such that those wheels closest to the first stair are at least slightly higher than said stair tread, sliding said wheels by means of said first linear slide-bearing inner race slide toward said stairs until wheels sufficient to support the chair are resting on the ground level and the first stair tread, locking said wheels from rotation and lowering said wheels downward into chair-supporting contact with said ground level and said first stair tread, sliding by means of said first and second slide-bearing outer race slides said chair seat toward said first stair until substantially centered over said wheels, adjusting said feet in elevation upwards more than one-half of a stair riser in height, whereby said chair is elevated by operation of the elevating levers connected through slide bearings and frame to said feet, articulating said feet such that those feet closest to the first stair are at least slightly higher than said stair tread, sliding said feet by means of said second linear slide-bearing inner race toward said stairs until feet sufficient to support the chair are resting on the ground level and the first stair tread, adjusting and locking said feet downward into chair-supporting contact with said ground level and first stair tread, wherein said sequence of operation less the articulation steps is repeated until said stairs are climbed and said wheels are again in supporting and transporting position on level ground.

2. The wheelchair of claim 1 wherein said inner supporting feet means includes a plurality of rollers mounted on axles longitudinal to said chair, said rollers oriented to permit said chair to be rolled sidewise when supported on said rollers.

3. The wheelchair of claim 2 wherein the drive wheel means is driven by a pair of handwheels on each side of said chair accessible from said chair, said means including sprocket and drive chain means interconnecting said handwheels with said drive wheels.

4. The wheelchair of claim 1 wherein said wheels comprise a pair of drive wheels rotatable from said chair to transport said chair and a pair of supporting, steerable caster wheels.

5. The wheelchair of claim 1 wherein said means for adjusting the height of both wheels and feet, alternatively, is achieved by a single means, comprising:

a pair of pinions rotationally fixed to each side of chair;

a pair of racks, each including a free end urged into meshing contact with said pinion and an opposite end pivotably attached to the first linear bearing outer race slide and one end of said paralleling lever; and a driving means for rotating said pinions, said means including a braking means for always locking said pinion against rotation except when the driving means are actuated, wherein actuating said driving means causes a change in elevation of said wheelchair seat, and alternatively, depending upon the direction of rotation, the wheels or feet, with the non-elevated wheels or feet remaining supporting said chair.

6. The wheelchair of claim 1 wherein said chair and wheels are conventionally positioned with respect to one another when in the supporting and transporting position, permitting passage of said chair through conventional width doors, with said first linear bearing pair arranged below said chair and said inner feet and second linear bearing pair combination arranged below said chair and inside said first bearing pair with respect to said chair center line and under said chair.

7. A stair-climbing wheelchair, comprising:

a chair assembly including a chair seat, a pair of elevating levers, one pair on each side of said chair, each comprising a pair of substantially horizontal, parallel lever members pinned at their midpoints to a post perpendicularly attached to said chair seat, whereby said post remains vertical and hence the chair level while the levers, in parallel, may pivot about the midpoint pins;

two pairs of linear bearings, each pair including one bearing on each side of said chair in horizontal alignment, each bearing including an outer race slide and an inner race slide, each outer race slide pinned to the ends of the elevating levers, said pairs of outer race slides on each side of the chair substantially in vertical alignment, pinned on the outer opposite sides and opposite ends of the elevating levers such that with respect to the chair center line, there is an outer first slide bearing and an inner second slide bearing whereby the outer and inner slides may be adjusted vertically with the slides always remaining substantially horizontal;

a wheel assembly including groups of wheels fore and aft with respect to said chair for supporting and transporting said chair, said wheels mounted on a frame pivotably attached to a vertical post member which is fixed to the horizontal inner slides of the first slide bearing, whereby the wheel groups may be articulated about said pivot and locked such that the chair is supported by said wheels, some in supporting contact with one tread or surface and some in supporting contact with another tread or surface at a different elevation;

an inner feet assembly including groups of feet supporting means fore and aft with respect to said chair for supporting said chair, said feet mounted on a frame means pivotably attached to a vertical post member which is fixed to the horizontal inner slide of the second slide bearing, whereby the feet group may be articulated in the vertical direction about said pivot and locked such that the chair is supported by said feet with some feet in supporting contact with one tread or surface and some in supporting contact with another tread or surface at a different elevation;

a means for adjusting the elevation of said outer races with respect to each other, whereby the wheels and feet may be adjusted, alternatively, between a chair-supporting position and a height greater than risers of the stairs to be climbed; and locking means for both wheel and feet assemblies which lock the assemblies into a chair-supporting position with the chair level while the wheels or feet are articulated into supporting contact with the treads or surfaces at different elevations, whereby climbing stairs is accomplished by a series of adjusting the feet to suport the chair, adjusting the wheels in elevation at least one-half stair riser in height, which also elevates said chair one-half as much, articulating the wheels such that a wheels group closest to the stairs clears the tread, sliding the wheels toward the stairs, whereby a supporting group of wheels rests on the tread of the first stair and another supporting wheel group remains on the level surface, locking said wheels and adjusting said wheels in elevation such that all wheels are in contact with treads and surfaces to support said chair, sliding said chair seat toward said stairs over said supporting wheels by means of both said first and second slide-bearing outer slides, wherein the sequence is repeated, alternatively adjusting the feet and wheels in elevation until the stairs are climbed.

8. The wheelchair of claim 7 wherein said locking means for locking an articulated inner feet assembly to support said chair, comprises:

a threaded rod anchored to the feet assembly while the other end of said rod extends upward to the wheelchair occupant;

a first vertical post upon which is pivoted a longitudinal beam upon which the feet are mounted for vertical articulation about said pivot, said post including a member for supporting threaded nut means which are engagable with said rod, which member includes spring means for biasing said nut means away from engaging said rod; and a second vertical post connected by said frame means to said inner slide bearings and supported by said first vertical post, said second post including a wedge pin and linkage means for transmitting vertical movement of said second post wedge pin to overcome said spring biasing means causing said locking nuts to engage said threaded rod, wherein said feet are freely articulable by the chair occupant moving said threaded rod vertically when said feet are raised from the ground so that the feet nearest a stair can be elevated to a higher tread while those away from the stair are lowered into contact with a lower tread, but when weight of the chair is transferred onto said feet through the vertical post, said second post moves with respect to said first post slightly vertically causing said locking nuts to engage said threaded rod to lock the articulated feet to support the chair.

9. The wheelchair of claim 8 wherein said locking means threaded rod is anchored by a trunnion means to said feet and rotation of said threaded rod by said chair occupant while the feet are supporting said chair provides minor changes in the level of said chair.

10. The wheelchair of claim 8 wherein sliding said wheels, chair and inner feet assembly horizontally during climbing is accomplished by the wheelchair operator.

11. The wheelchair of claim 8 wherein said locking means and feet assembly includes a handle mounted on a collar about said threaded rod within reach of said chair occupant, said collar connected to said feet supporting frame means wherein when the weight of the chair is on the wheels, the handle is rotatable axially with respect to the chair, rotating said feet fixed to said first vertical supporting post about said second vertical supporting post whereupon when the weight of the chair is transferred to said feet the entire wheelchair rotates about said second vertical post in an amount equal to the rotation of said handle.

12. The wheelchair of claim 7 wherein said locking means for locking the articulated wheel assembly to support said chair, comprises, on each side of said chair:

a threaded rod having one end within reach of said chair occupant, said rod fixed to a block for mounting a drive wheel which is connected by driving means to said wheelchair wheels;

a first vertical post pivotably connected to said wheel support frame, said post including a support member for slidably guiding said rod and drive wheel mounting block wherein said threaded rod passes between threaded nut means engagable with said rod but biased therefrom by spring biasing means; and a second vertical post having one end connected to the inner slide of said first slide bearing and the other end nesting in slidable supporting contact with said first vertical post, said post having a means for engaging and overcoming said spring biasing means to lock said nuts about said rod, wherein when wheelchair weight is on the feet supporting means and said wheels are elevated, said wheels are free to articulate and said locking threaded rod free to pass between said biased locking nuts, but when said weight is transferred to said wheels, said second vertical post in transmitting weight in said wheelchair to said wheels moves slightly vertically relative to said first vertical post, overcoming said biasing spring causing said locking nuts to engage said threaded rod and lock said wheels into articulated support of said chair.

13. The wheelchair of claim 7 wherein the means for adjusting the elevation of wheels or inner feet and transferring weight of the chair therebetween, comprising, on each side of said chair:

a pinion gear rotatably fixed to said chair and driven by a drive means actuated by said chair occupant;

a pair of racks meshing with said pinion, one each vertically fixed to each slide bearing outer race; and vertical guides for supporting said racks fixed to said chair, wherein actuating said pinion raises or lowers a supporting assembly, depending upon direction of rotation of said pinion, while the other supporting assembly supports said chair, and continued rotation in one direction transfers weight from one supporting assembly to the other.

14. The wheelchair of claim 7 wherein locking means for securing said slide bearings from unexpected horizontal movement comprise:

latch actuating means accessible to said chair occupant; and linkage means, connected to said latch, which engage lugs on said outer bearing slides.

15. The wheelchair of claim 7 wherein all horizontal and vertical movement of said wheelchair is accomplished by motor means.

* * * * *